United States Patent [19]

Salzberg

[11] 4,366,454

[45] Dec. 28, 1982

[54] MICROWAVE HYBRID PHASE MODULATORS

[76] Inventor: Edward Salzberg, 19 Black Oak Rd., Wayland, Mass. 01778

[21] Appl. No.: 214,495

[22] Filed: Dec. 9, 1980

[51] Int. Cl.[3] ..... H01P 1/18

[52] U.S. Cl. ..... 333/164; 332/23 R; 333/121; 375/52; 375/67

[58] Field of Search ..... 332/16 R, 23 R; 375/52, 375/55–57, 67; 333/117, 120–122, 164

[56] References Cited

U.S. PATENT DOCUMENTS

| | | | |
|---|---|---|---|
| 3,233,194 | 2/1966 | Alford | 333/117 X |
| 3,492,603 | 1/1970 | Fredrick, Jr. | 333/117 X |
| 3,571,765 | 3/1971 | Friedman | 333/164 |
| 3,931,599 | 1/1976 | Salzberg | 333/164 |

*Primary Examiner*—Siegfried H. Grimm
*Attorney, Agent, or Firm*—Thomas N. Tarrant

[57] ABSTRACT

Microwave phase modulators are described utilizing three or more hybrid junctions, two of which are phase quadrature hybrids each having one pair of conjugate terminals terminated with switching means and each having one of the remaining terminals connected to a respective terminal of a third hybrid junction. With power in at a third terminal of the third hybrid junction, power out at the 4th terminal of the third hybrid junction can be selectively shifted 180° or switched off by operation of the switching means. Broad band operation is achieved and reflections by the switching means do not have to have a precise phase tolerance as long as they are similar.

5 Claims, 2 Drawing Figures

MICROWAVE HYBRID PHASE MODULATORS

BACKGROUND OF THE INVENTION

1. Field of the Invention

The invention relates to the use of microwave hybrid junctions as phase modulating and switching devices.

2. Description of the Prior Art

Hybrid junctions are a common type of directional coupler used in microwave systems today. The hybrid junction as used herein is a 4 terminal pair device which ideally has the property that power supplied to a given terminal is divided between two of the 3 remaining terminal pairs with nothing coupled to the 4th terminal pair. One of the most common classes of microwave hybrid junctions is a 3 DB directional coupler known as the phase quadrature type. The phase quadrature junction is usually two lengths of wave guide positioned in parallel and having a common wall. A symmetrical coupling element between the two lengths of wave guide usually takes the form of a slot in the common wall. A second well known class of hybrid junction is best known by the designation magic tee. The magic tee is an E and H plane tee junction having a first pair of symmetrical arms, which may be colinear, an H-plane arm and an E-plane arm. The H-plane and E-plane arms are connected to the colinear arms at their midpoint to form the junction.

H. Seidel, in U.S. Pat. No. 3,559,108, describes 3 DB coupler switches in which one pair of conjugate terminals is terminated with switchable impedances. Seidel describes the use of quadrature couplers and magic tee couplers as switches with high attenuation in the open state and bandpass characteristics in the closed state. U.S. Pat. No. 3,500,259 also to Seidel, is a related patent describing the use of hybrids with switchable terminations as filter circuits. U.S. Pat. No. 3,931,599 of Edward Salzberg (the present inventor) describes a phase inverter using hybrid junctions in which terminals terminated with switchable impedances are always controlled to have opposite impedance conditions. Seidel was primarily interested in filters and apparently did not recognize the possibilities of broadband phase switching. The tee type phase inverter of Salzberg did not stay well matched unless the terminating impedances were always in opposite states.

SUMMARY OF THE INVENTION

In accordance with the present invention, it has been found that terminating two terminals of a first hybrid junction with two phase quadrature hybrid junctions each having a pair of conjugate terminals terminated with switchable impedances provides broadband 180° phase switching. Further objects and features of the invention will become apparent upon reading the following description together with the drawing.

DESCRIPTION OF THE PREFERRED EMBODIMENT

Figure 1:
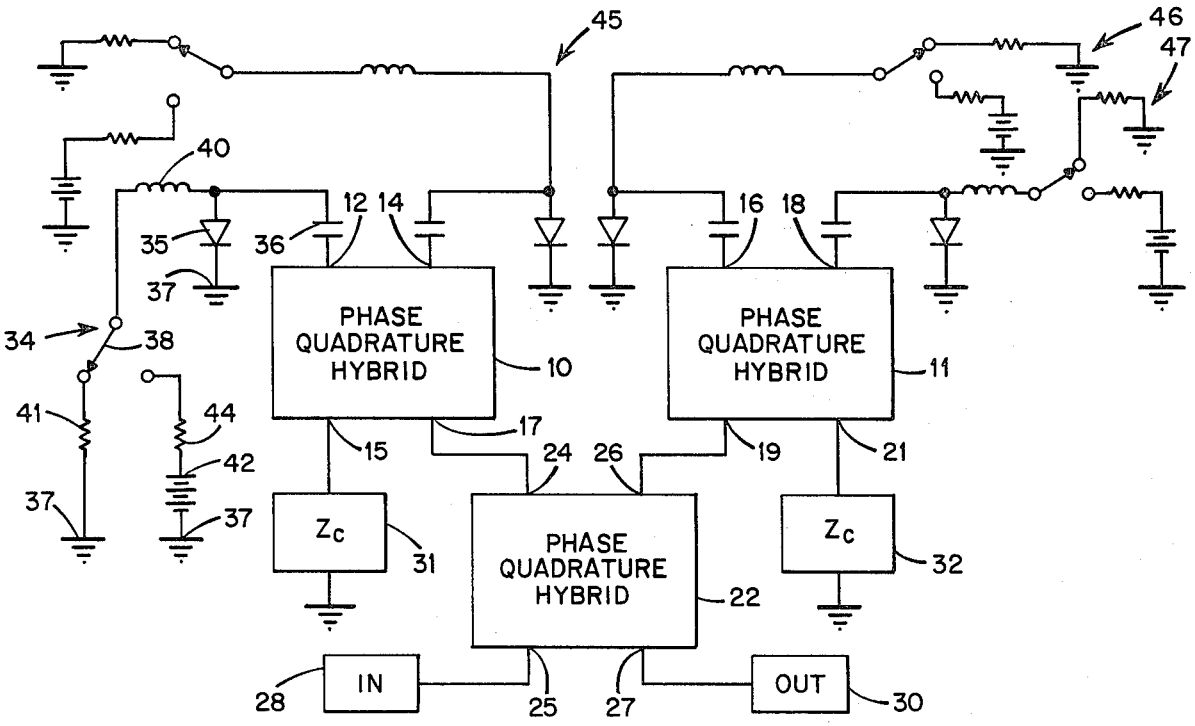
FIG. 1, is a schematic diagram of a phase modulator according to the invention wherein two phase quadrature hybrid junctions terminate one pair of conjugate terminals of a third phase quadrature hybrid junction.
Figure 2:
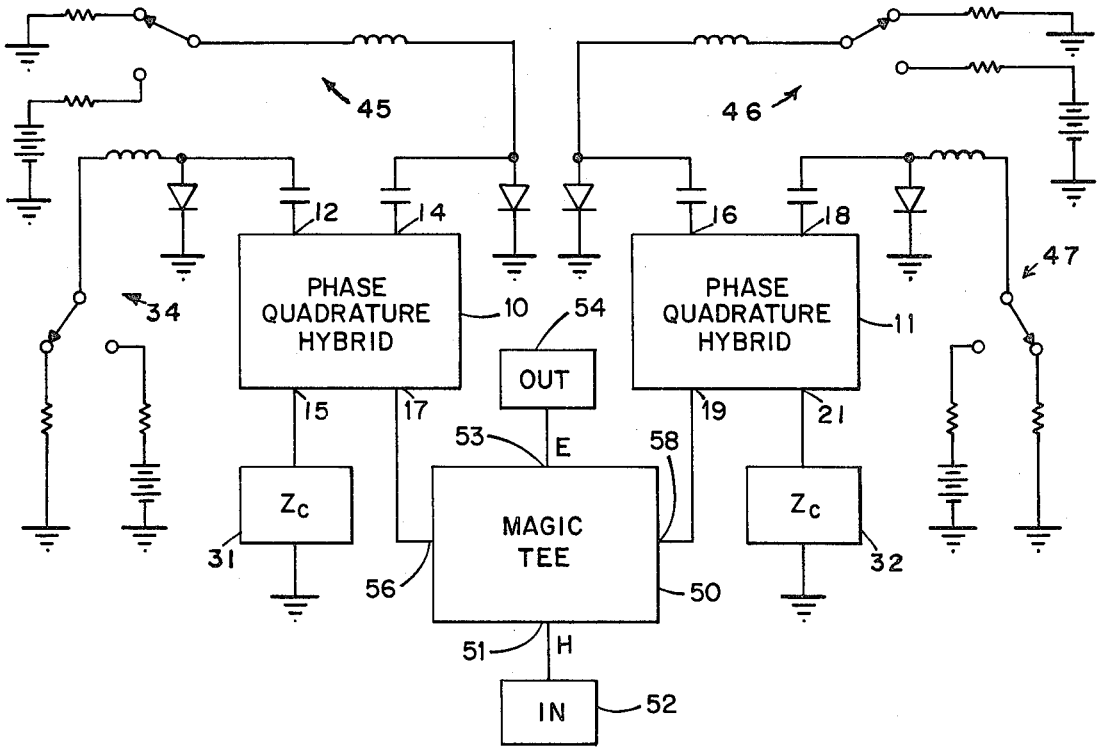
FIG. 2 is a schematic diagram of a second embodiment of the invention in which two phase quadrature hybrid junctions terminate the symmetrical terminals of a magic tee junction.

FIGS. 1 and 2 depict two preferred embodiments in which the only difference is that FIG. 2 uses a magic tee in place of one of the phase quadrature hybrid junctions of FIG. 1. Accordingly the same reference numeral designations will be used with both Figs. except for the dissimilar junctions. What has been a virtually insurmountable problem in handling electromagnetic energy at microwave frequencies is to perform switching and phase shifting functions over a broad band with a high degree of accuracy and no change in insertion loss. The switching elements never act precisely the same in both switch states.

As will be seen in the following description, a directional coupler, having primary input and output terminals, is isolated from the basic switching elements by additional directional couplers. As depicted in FIGS. 1 and 2, the isolating directional couplers are phase quadrature hybrids 10 and 11. While the hybrid junctions of the present invention can be made in strip line or other known ways without departing from the inventive concept, the following description will be given in terms of waveguide junctions. Thus hybrids 10 and 11 can be thought of as each comprising two parallel lengths of waveguide joined by a common wall. The terminal pairs at a first end of hybrid 10 are conjugate ports 12 and 14. Terminals at the opposite end of hybrid 10 are ports 15 and 17. For hybrid 11 the terminals at one end are designated ports 16 and 18. While the terminals at the other end are designated ports 19 and 21.

Third phase quadrature hybrid 22 has a first set of terminal pairs as conjugate ports 24 and 26 and, at its opposite end, a second set of terminal pairs as conjugate ports 25 and 27. Port 25 is connected to input terminal 28 and port 27 is connected to output terminal 30. However, it has to be understood that these are interchangeable and that ports 25 and 27 can also be used individually as both input and output terminals. Ports 24 and 26 are connected to ports 17 and 19 respectively of hybrids 10 and 11. Port 15 is depicted as terminated with its characteristic impedance 31 and port 21 is depicted as terminated with its characteristic impedance 32. Impedances 31 and 32 may in some instances be signal connections. Ports 12 and 14 of hybrid 10 and 16 and 18 of hybrid 11 are each terminated with similar switching circuits. Since these switching circuits are depicted as identical, only one of them will be described in detail. Switching circuit 34 is connected to port 12 with diode 35 acting as the switched impedance. Diode 35 is connected to port 12 through coupling capacitor 36 which passes the microwave energy but blocks DC so that the voltage biasing diode 35 will not be shorted out. Diode 35 is depicted with its anode connected to coupling capacitor 36 and its cathode connected to reference potential point 37. Switch 38 is connected to the anode of diode 35 through RF choke 40. RF choke 40 serves to block the microwave energy from the biasing supply. Switch 38 is arranged to connect either reference 37 through impedance 41 or positive biasing source 42 through impedance 44. It will be recognized that a negative biasing source can be used with impedance 41. Also diode 35 can be reversed along with a reversal in biasing sources. Switching circuit 45 is connected with port 14, switching circuit 46 is connected to port 16. Switching circuit 47 is connected to port 18. As has been stated, switching circuits 34, 45, 46, and 47 are all depicted as identical.

Hybrids 10 and 11 are preferably identical. It would be understood that its an important aspect of the invention that ports 24 and 26 of hybrid 22 be perfectly matched under the various conditions of operation. This is best achieved with identical hybrids 10 and 11. Having hybrid 22 identical to hybrids 10 and 11 further simplifies design problems. Switching circuits 34, 45, 46 and 47 should all be similar, that is their reactive and resistive characteristics should be matched as seen by the hybrid ports. The specific reactance and or resistance or the amount of change upon switching is not as critical for correct operation of the circuit as long as it is the same for each of the switching circuits. Operation of the circuit is given in the following table I.

TABLE I

TRUTH TABLE FOR FIG. I

| Switch Circuit | | | | Port | | |
|---|---|---|---|---|---|---|
| 34 | 45 | 46 | 47 | IN | OUT | Phase |
| ON | OFF | OFF | ON | 25 | 27 | 0° |
| OFF | ON | ON | OFF | 25 | 27 | 180° |
| ON | ON | ON | ON | 25 | 31 + 32 | — |
| OFF | OFF | OFF | OFF | 25 | 31 + 32 | — |

The other 12 possible switch conditions will produce useful results easily determined by those skilled in the art. They are not listed in the Table since they are not necessary for the described operations.

TABLE II

TRUTH TABLE FOR FIG. 2

| Switch Circuit | | | | Port | | |
|---|---|---|---|---|---|---|
| 34 | 45 | 46 | 47 | IN | OUT | Phase |
| ON | OFF | ON | OFF | 51 | 53 | 0° |
| OFF | ON | OFF | ON | 51 | 53 | 180° |
| ON | ON | ON | ON | 51 | 31 + 32 | — |
| OFF | OFF | OFF | OFF | 51 | 31 + 32 | — |

In Table I (and in Table II herein) switch circuit "ON" is the condition when the bias source is connected to forward bias the diode. The phase of the output power in Table I is not with respect to the input power, but only with respect to the phase in the opposite switch position. It will be recognized that with all the switches ON or all OFF, there is no output at port 27 (or 53). Outputs 31 and 32 would not normally be used for phase modulation and so the phase is not indicated.

It will be seen from Table I, that when a microwave signal is coupled into terminal 28, depending upon the switches in switch circuits 34, 45, 46 and 47, an output can be obtained at output 30 which can be shifted in phase by 180° or switched off. In the switched off position, the output appears at ports 15 and 21 and the attenuation at output 30 is substantially infinite. Also, with the switching to obtain 180° phase shifts, the insertion loss is small and substantially the same both ways. While this arrangement places some requirements on matching the switching elements to each other, it is still a very practical arrangement since other devices that will perform similar functions require hard-to-obtain characteristics in the switching elements: in other words, a precise high degree of accuracy of a specific reactance and a specific resistance parameter.

The embodiment of FIG. 2 is essentially similar except that hybrid 22 is replaced by magic tee 50. The switch positions for particular results using magic tee 50 are different than with the hybrid 22 and can have advantages in specific applications. Also the mechanical configurations available with the magic tee allow it to interconnect with other equipment with greater facility in some specific applications than is possible with hybrid 22. The symmetric ports 56 and 58 of magic tee 50 are connected to ports 17 and 19 respectively of hybrids 10 and 11. The H-arm port 51 is connected to input terminal 52 and the E-arm port 43 is connected to output terminal 54. Again input and output can be interchanged. The more significant parameters of a truth table for FIG. 2 are set forth in Table II.

While switching circuits in the figures are depicted as mechanical switches, in practical applications, the switching would be electronic.

The embodiments of FIGS. 1 and 2 are theoretically 180° modulators perfectly matched in both states. Also theoretically they can be used as switches with infinite isolation. In practical application however, these can be made to work, not really perfectly, but with a high degree of perfection over a broad band and with no great problems in achieving an excellent match. The reason is that the two hybrid modulators (10 and 11), using imperfect but similar switching elements, create a theoretically perfect switching interface at the input hybrid or tee (22 or 50).

While the invention has been described with relation to two specific embodiments, variations obvious to those skilled in the art, such as the use of ferrites for the switchable impedances, are contemplated and it is intended to cover the invention as set forth in the appended claims.

I claim:

1. A microwave phase modulator having in combination at least three hybrid junctions comprising:

(a) first and second hybrid junctions of the phase quadrature type each having two pairs of conjugate ports;

(b) a switchable impedance terminating each port of one pair of conjugate ports of each of said first and second hybrid junctions;

(c) a third hybrid junction having a first port connected to one of the remaining ports of said first hybrid junction, a second port connected to one of the remaining ports of said second hybrid junction a third port and a fourth port;

(d) an input terminal connected to said third port of said third hybrid junction; and, (e) an output terminal connected to said fourth port of said third hybrid junction.

2. A microwave phase modulator according to claim 1 wherein said third hybrid junction is of the phase quadrature type and said first port and said second port of said third hybrid junction are conjugate ports.

3. A microwave phase modulator according to claim 1 wherein said third hybrid is a magic tee having two symmetrical arms terminated with ports, an E-plane arm and an H-plane arm each terminated with ports.

4. A microwave phase modulator according to claim 3 wherein said first port and said second port of said third hybrid junction are ports terminating symmetrical arms.

5. A microwave phase modulator according to claim 1 wherein said switchable impedances are unilaterally conducting diodes connected in a switching circuit with provisions for biasing them in conducting and nonconducting states.

* * * * *